US009194583B2

(12) United States Patent
De La Sovera

(10) Patent No.: US 9,194,583 B2
(45) Date of Patent: Nov. 24, 2015

(54) MIXED FUEL VACUUM BURNER-REACTOR

(71) Applicant: Jorge De La Sovera, Montevideo (UY)

(72) Inventor: Jorge De La Sovera, Montevideo (UY)

( * ) Notice: Subject to any disclaimer, the term of this patent is extended or adjusted under 35 U.S.C. 154(b) by 267 days.

(21) Appl. No.: 13/772,075

(22) Filed: Feb. 20, 2013

(65) Prior Publication Data

US 2014/0234787 A1 Aug. 21, 2014

(51) Int. Cl.

| | |
|---|---|
| ***F23C 1/00*** | (2006.01) |
| ***F23G 5/12*** | (2006.01) |
| ***F23C 1/08*** | (2006.01) |
| ***F23C 3/00*** | (2006.01) |
| ***F23C 5/32*** | (2006.01) |
| ***F23G 7/00*** | (2006.01) |
| ***F23L 9/02*** | (2006.01) |
| ***F23C 6/04*** | (2006.01) |
| ***F23D 14/04*** | (2006.01) |
| ***F23D 17/00*** | (2006.01) |

(52) U.S. Cl.

CPC ... *F23G 5/12* (2013.01); *F23C 1/08* (2013.01); *F23C 3/00* (2013.01); *F23C 5/32* (2013.01); *F23C 6/042* (2013.01); *F23D 14/04* (2013.01); *F23D 17/002* (2013.01); *F23G 7/008* (2013.01); *F23L 9/02* (2013.01); *F23C 2201/301* (2013.01); *F23D 2900/14241* (2013.01); *F23D 2900/14701* (2013.01)

(58) Field of Classification Search

CPC ..... F23C 1/00; F23C 3/00

USPC ..... 431/12, 75; 110/309

See application file for complete search history.

(56) References Cited

U.S. PATENT DOCUMENTS

| | | | | |
|---|---|---|---|---|
| 3,245,457 | A * | 4/1966 | Smith et al. | 431/6 |
| 4,741,279 | A * | 5/1988 | Azuhata et al. | 110/347 |
| 5,024,170 | A * | 6/1991 | Santanam et al. | 110/264 |
| 5,345,768 | A * | 9/1994 | Washam et al. | 60/737 |
| 7,707,833 | B1 * | 5/2010 | Bland et al. | 60/737 |

* cited by examiner

*Primary Examiner* — Avinash Savani

(74) *Attorney, Agent, or Firm* — Birch, Stewart, Kolasch & Birch, LLP

(57) ABSTRACT

A mixed-fuel vacuum burner-reactor includes a primary combustion chamber having a conical interior and a first set of directing blades. The conical interior is connected to an intake manifold on one end and a reduction nozzle on the other end. Injectors are mounted perpendicularly to the reduction nozzle to inject a second fuel into the primary combustion chamber. The reduction nozzle is connected to a cylindrical secondary combustion chamber having a second set of directing blades configured to direct air into the secondary combustion chamber. Methods of efficiently burning mixed fuels in a triple-vortex vacuum burner-reactor are also disclosed. Vacuum conditions are created and fuels are introduced into a conical primary combustion chamber. The fuels are passed over a first set of directing blades to form three vortices before additional fuels are injected in a direction opposite to a direction of rotation of the first set of fuels.

20 Claims, 8 Drawing Sheets

MIXED FUEL VACUUM BURNER-REACTOR

BACKGROUND

Burners are devices that burn fuel to generate heat in industrial settings, such as those used for generation of electricity, smelting of metals and other materials, and used for processing of chemicals and other substances. Due to incomplete combustion in previously designed burners, newer examples use generators inside the burner to create a vortex (i.e., rotating mixture of air and fuels) in order to supply more oxidants for the combustion process. While this accomplishes the goal of increased air-fuel mixture, an igniter is required for sustaining the combustion and this still may not accomplish complete in burning all of the fuel. Solutions that employ guide pieces and flow spaces (i.e., reactors) can also be used, but suffer from residue and cleaning difficulties, particularly when used with lower-quality fuels. Likewise, reactor solutions that employ a premix burner and a flame tube allow for staged combustion in individual mixers. However, these solutions also require high-quality, clean-burning fuels and suffer from maintenance issues resulting from residues.

SUMMARY OF THE INVENTION

According to embodiments of the present Application, a mixed-fuel vacuum burner-reactor includes a primary combustion chamber, an intake, a reduction nozzle, injectors, and a secondary combustion chamber. The primary combustion chamber has a conical interior and a first set of directing blades. The intake is connected to a first end of the conical interior. The reduction nozzle is connected to a second end of the conical interior. A first end of the reduction nozzle is connected to the conical interior of the primary combustion chamber and a second end of the reduction nozzle is connected to the secondary combustion chamber. The injectors are mounted perpendicularly to the reduction nozzle and configured to inject a second fuel into the primary combustion chamber. The second fuel is a liquid fuel, such as waste oil, alcohol (with up to 50% water added), Glycerin, soy oil, industrial fuel oil (IFO), or combinations thereof.

The primary combustion chamber is configured to enable two vortices of a first fuel entering and exiting the primary combustion chamber to form naturally, and the first set of directing blades is configured to create a third vortex sustaining rotation of the first fuel to the exterior of the burner-reactor. In some embodiments, the primary combustion chamber has an insulating material in a space between the cylindrical exterior and the conical interior. The secondary combustion chamber is cylindrical and comprises a second set of directing blades configured to direct air into the secondary combustion chamber.

In some embodiments, the mixed-fuel vacuum burner-reactor further includes an intake manifold connected to the intake portion. The intake manifold includes a vacuum chamber, a compressed air nozzle extending into the intake manifold, and an ejector outlet providing an outlet in some embodiments. According to some embodiments, the compressed air nozzle is configured to inject compressed air into the primary combustion chamber at the core of a flame. Gaseous fuel is supplied to the primary combustion chamber by way of the intake manifold in some embodiments. The gaseous fuel is natural gas, a water byproduct of water electrolysis (HHO), or combinations thereof. In some embodiments, the injectors are configured to inject fuel into the primary combustion chamber counter to the rotation of the vortices of fuel and/or are configured 30° to an axis of the chamber.

In other embodiments, a method of efficiently burning mixed fuels in a triple-vortex vacuum burner-reactor includes creating vacuum conditions in a conical primary combustion chamber by ejecting air through an intake manifold connected to the conical primary combustion chamber. The method continues by introducing fuels into the conical primary combustion chamber through the intake manifold, such that two vortices of a first set of fuels and outlet gases are formed. The method also includes passing the first set of fuels over a first set of directing blades in the conical primary combustion chamber to form a third vortex, the three vortices sustaining rotation through the conical combustion chamber and a secondary combustion chamber to the exterior of the burner-reactor. The method continues by injecting a second set of fuels into the conical primary combustion chamber in a direction opposite to a direction of rotation of the first set of fuels. In certain embodiments, the first set of fuels is gaseous fuels and the second set of fuels is liquid fuels.

BRIEF DESCRIPTION OF THE DRAWINGS

The following drawings depict an exemplary embodiment of the invention.

DETAILED DESCRIPTION

The presently depicted and disclosed burner-reactor will be described with respect to an exemplary embodiment. The disclosure should not be interpreted to be limiting or to require in the invention all described features. Where possible, like elements will be numbered in a like fashion for clarity. Illustrative alternatives will be given where applicable, but other equivalents may be readily apparent and are contemplated where appropriate.

Figure 1:
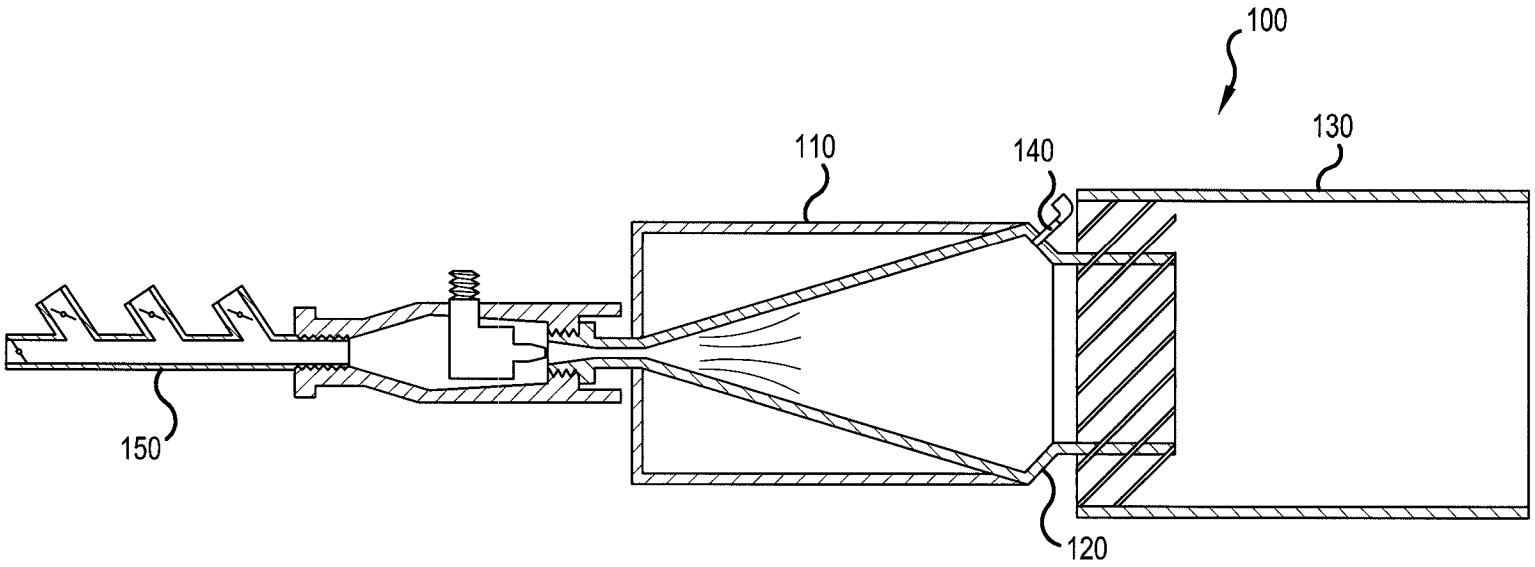
FIG. 1 is a diagram of a mixed fuel vacuum burner-reactor according to the present invention.

FIG. 1 depicts a cross-section of a mixed fuel vacuum burner-reactor 100 according to embodiments of the present disclosure. Burner-reactor 100 includes a primary combustion chamber 110 connected to a reduction nozzle 120, which is in turn connected to a secondary combustion chamber 130. Burner-reactor 100 further includes injectors 140 placed perpendicularly on reduction nozzle 120. Primary combustion chamber 110 is also connected to an intake manifold 150 opposite the reduction nozzle 120. Each of the elements above will be described in more detail below, but from a high-level perspective, gases and compressed air are introduced into the primary combustion chamber 110 from intake manifold 150 to begin a combustion process in vacuum conditions. Injectors 140 inject additional fuel to mix with the previously supplied fuels to create a fuel mixture. The fuel mixture, throughout its transit to the exterior of secondary combustion chamber 130, continues to rotate and moves slowly, causing more complete and cleaner combustion regardless of the quality of fuels utilized. In different embodiments, burner-reactor 100 can be connected to a furnace with a flange (not shown) before or after injectors 140.

Primary combustion chamber 110 has a cylindrical exterior with a conical interior as will be described with reference to FIG. 2 below. The conical interior connects at its smaller end to intake manifold 150 and at its larger end to reduction nozzle 120. Fuels and compressed air are introduced into primary combustion chamber 110 from intake manifold 150, causing combustion in the primary combustion chamber 110 (i.e., as a burner). According to embodiments of the present disclosure, any type of combustible gas can be utilized. For example, natural gas could be used, as could HHO, the byproduct of water electrolysis.

At least in part because intake manifold 150 and primary combustion chamber 110 are configured to operate at vacuum conditions, high temperatures and easy, immediate thermal cracking can be achieved. Because of the vacuum conditions, the gases are drawn into the combustion chamber rather than being pushed into the chamber. This allows the burning of gases that become explosive while being compressed (such as HHO) and more efficient oxidation of heavier fuels. The vacuum conditions also enable specific thermal objectives, such as insulation of the primary combustion chamber and faster start-up of the burner-reactor than if vacuum conditions are not utilized.

During this stage of the combustion process, the fuels supplied into primary combustion chamber 110 from intake manifold 150 create two vortices of inlet and outlet gases naturally from the vacuum conditions. These naturally occurring vortices come about when the vacuum conditions cause the gas entering and exiting the chamber to rotate due to the pressure differences, similar to water entering or leaving in rapid fashion in fluid dynamics or as does air behind the wing of an aircraft.

While not necessary once operating, the primary combustion chamber is preheated using a small amount of fuel, such as HHO and natural gas. For example, 3 $m^3$/hr of HHO and 16 $m^3$/hr of natural gas can be used to preheat the chamber to approximately 2200 degrees for 20 minutes prior to introducing a second fuel into the system as described below. Once burner-reactor 100 has been preheated, the HHO can be removed without affecting performance. The HHO provides oxygen and a hydrogen laminar flow speed to the flame seven times faster than methane, thus allowing better cracking and combustion, and once again lowering the emissions.

Figure 2:
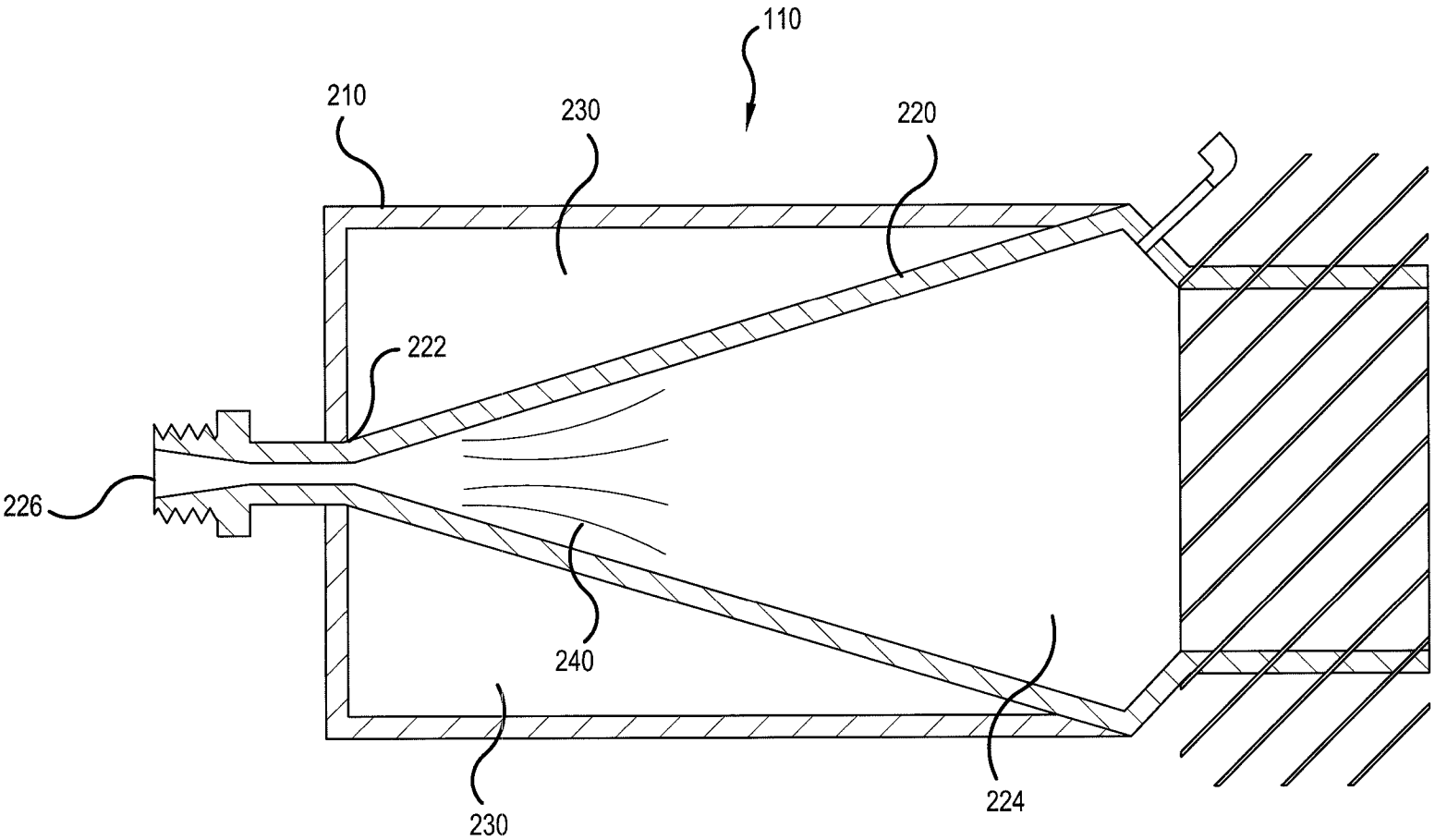
FIG. 2 is a cross-sectional diagram of a primary combustion chamber according to the present invention.

FIG. 2 is a cross-sectional diagram of a primary combustion chamber 110 according to embodiments of the present disclosure. Primary combustion chamber 110 has a cylindrical exterior 210 and a conical interior 220. Insulating material 230 is included between exterior 210 and interior 220. Also, primary combustion chamber 110 has a first set of directing blades 240 within conical interior 220. Directing blades 240 are configured to create a third vortex in primary combustion chamber 110 by which the two vortices of rotating fuels are surrounded, creating a third vortex. This third vortex slows the transit of the fuel through the burner-reactor, resulting in complete and clean combustion without regard to fuel quality.

Conical interior 220 has a first end 222 and a second end 224. First end 222 is the smaller end of the cone-shaped interior, and provides the entry point for the fuel gases and compressed air which enter from intake manifold 150. Primary combustion chamber 110 can include a threaded connection 226 at first end 222 for use with a counterpart connection of intake manifold 150 in order to introduce the fuels into the combustion chambers of the burner-reactor.

Intake manifold 150 and primary combustion chamber 110 should be connected in such a way that the associated vacuum chamber connected to the primary combustion chamber can create vacuum conditions for the gases to be sucked into primary combustion chamber 110. Compressed air is also fed into the core of the flame in primary combustion chamber 110, rather than sprayed and ignited as in many conventional burners. In some embodiments, primary combustion chamber 110 is made of a material such as insulated stainless steel, so as to eliminate adherence of combustion residues. The lack of obstructions as seen with typical reactor solutions also upgrades maintenance and reliability.

Figure 3:
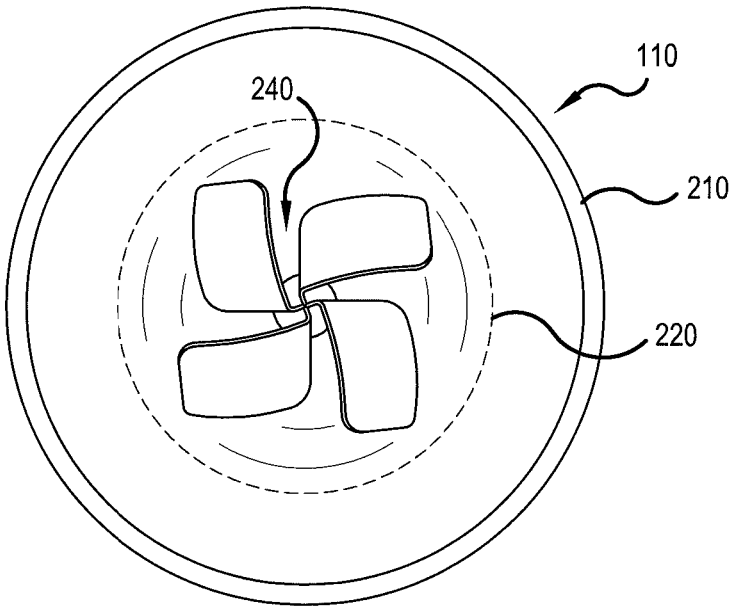
FIG. 3 is a rear view of the primary combustion chamber of FIG. 2.

FIG. 3 is a rear view of the primary combustion chamber 110 of FIG. 2, according to embodiments of the present disclosure. Shown in this view are the cylindrical exterior 210, the conical interior 220 along a portion of the cone (shown as a dashed circle concentric to exterior 210), and a first set of directing blades 240. Directing blades 240 cause the fuels which are entering the primary combustion chamber from behind the blades, by way of intake manifold 150, to rotate in the third vortex. In this figure, the fuel would be both rotating in a clockwise or counterclockwise direction, and it would be transiting the system such that it would be pushed out of the diagram toward the viewer.

Injectors 140 on reduction nozzle 120 supply additional fuels to the already rotating fuels introduced on the opposite end of primary combustion chamber 110. The fuels injected by injectors 140 are supplied in a direction opposite the flow of the previously introduced fuels (i.e., the gaseous fuels supplied from the intake manifold 150). These fuels are fluids, and can be any quality of fuel available. For example, experimental data is given below showing the operation of the described embodiments on soy oil, waste oil, Glycerin, refined higher quality hydrocarbon fuels, as well as various mixtures of these fluids. Other liquid fuels include alcohol, which needs not be free of water. For example, alcohol with as much as 50% water included has been utilized with the described embodiments.

Figure 4:
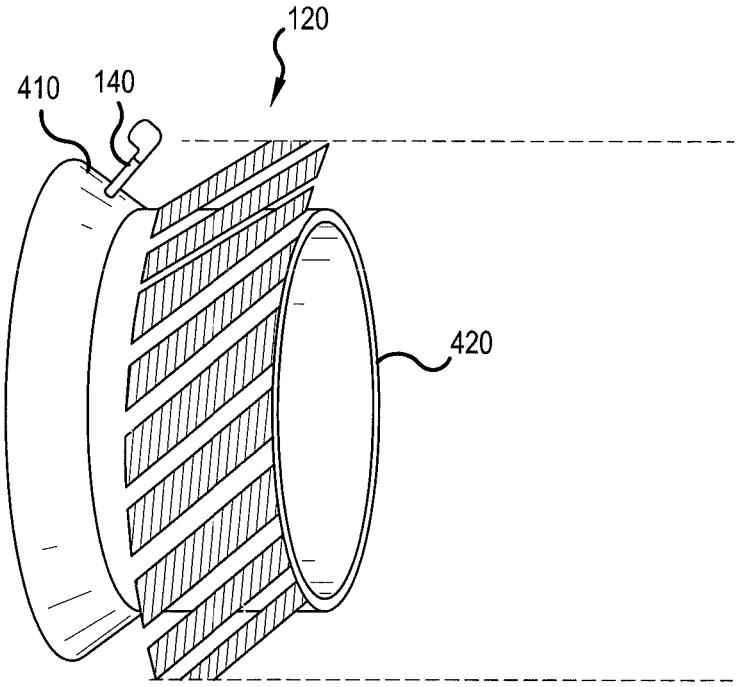
FIG. 4 is a perspective diagram of a reduction nozzle connecting the primary combustion chamber and a secondary combustion chamber according to the present invention.

FIG. 4 is a perspective diagram of a reduction nozzle 120 according to embodiments of the present disclosure. Reduction nozzle 120 is configured for connection to the second end 224 of the conical interior 220 of the primary combustion chamber 110 as described above. Reduction nozzle 120 has a frustoconical first portion 410 with a larger diameter in order to connect to the primary combustion chamber 110. Reduction nozzle 120 has a cylindrical second portion 420 that extends from a smaller diameter of the frustoconical first portion 410 into secondary combustion chamber 130.

First portion 410 has injectors 140 mounted thereon which allow for the injection of the second set of fuels, i.e., the liquid fuels, into the primary chamber 110. Injectors 140 are mounted perpendicularly to the first portion 410. Where the first portion has an approximate 60° angle to horizontal on which the injectors are mounted, the injectors would be mounted to enter the primary chamber at an approximate 30° angle when viewed relative to a horizontal plane and in the opposite direction to the flow of the rotating gaseous fuels. Blades (shown but not numbered) are welded to the cylindrical second portion 420 of the reduction nozzle 120 at 45 degrees to the longitudinal axis. These blades will be described in greater detail below.

Because of the high temperatures and pressures generated by the described embodiments, injectors 140 are cooled. In some embodiments, injectors 140 are cooled by cooling nozzles (not shown or numbered). In some embodiments, cooling nozzles are part of an open circuit utilizing reduced compressed air or gas. For example, approximately 0.5 $Kg/cm^2$ of compressed air or gas is used in an open circuit that drains inside the apparatus. In other embodiments, a closed oil and pump system is used. With such a closed system, the oil and pump simultaneously heats the service tank through a heat exchanger.

Figure 5A:
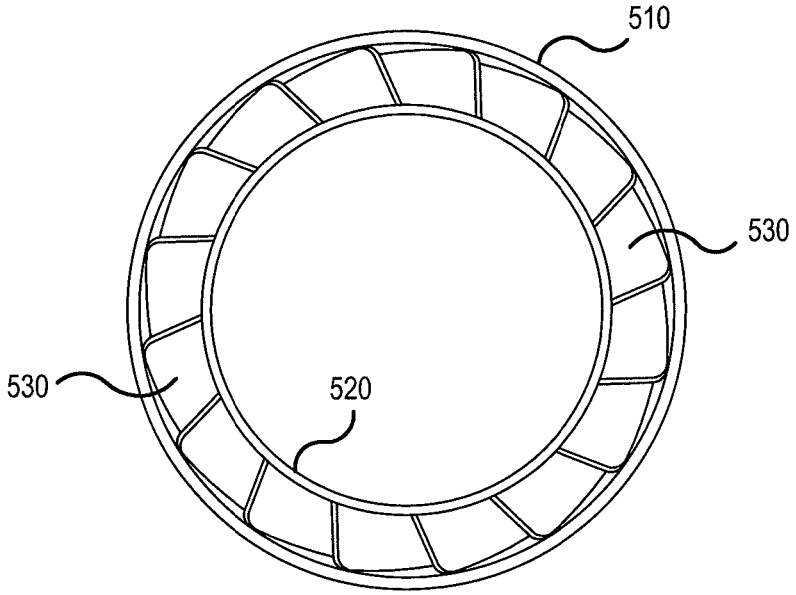
FIG. 5A is a front view of the secondary combustion chamber according to the present invention.
Figure 5B:
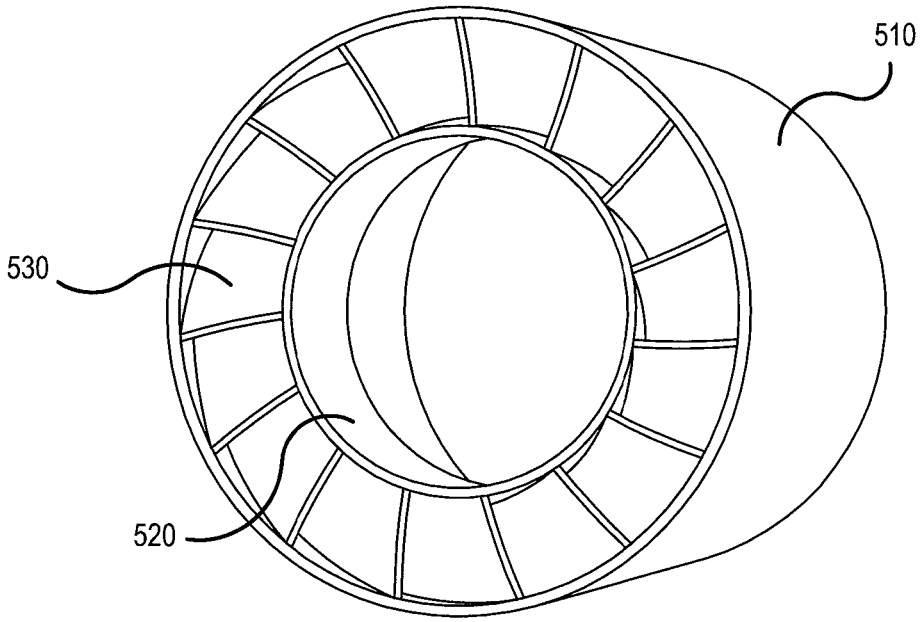
FIG. 5B is a perspective view of the secondary combustion chamber according to the present invention.
Figure 5C:
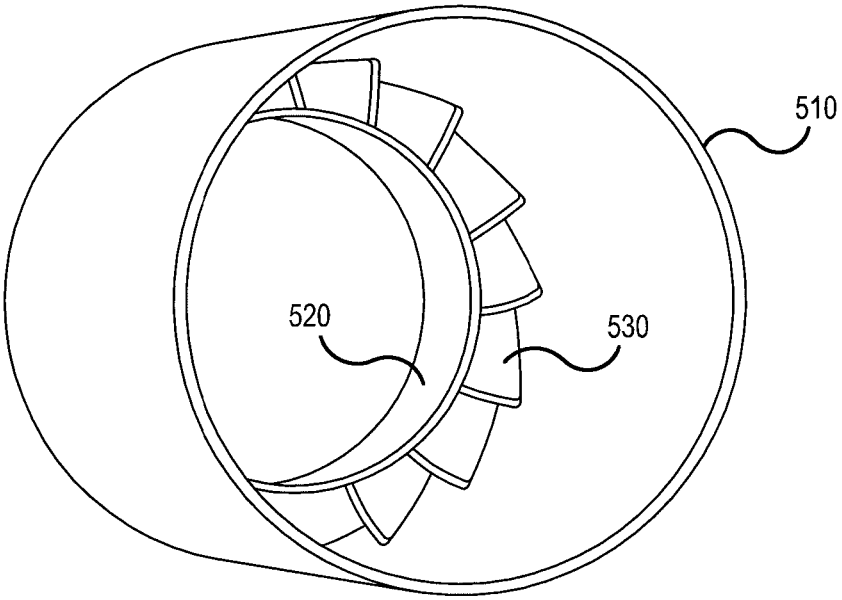
FIG. 5C is a rear view of the secondary combustion chamber according to the present invention.

FIG. 5A is a front view of a secondary combustion chamber 130 according to embodiments of the present disclosure. FIGS. 5B and 5C are perspective and rear views of the secondary combustion chamber 130 according to embodiments of the present disclosure. The cylindrical secondary combustion chamber 130 has an outer diameter 510 and an inner diameter 520 in which the second portion 420 of reduction nozzle 120 inserts. Between the two diameters are blades 530, which serve as an air inlet for the secondary combustion chamber 130. Thus, additional air in excess of the gaseous fuels and the compressed air fed to the core of the flame are available for more complete oxidation of the gaseous-liquid fuel mixture. The gas-liquid mixture continues to rotate as it is pushed toward the exterior of the secondary combustion chamber 130, allowing for complete combustion. Because of this enhanced process, without the use of guide pieces, flow spaces, or flame tubes as found in conventional solutions, fewer residues are created and/or build up. Again, this allows for cleaner emissions by the system regardless of the fuel quality utilized.

Figure 6:
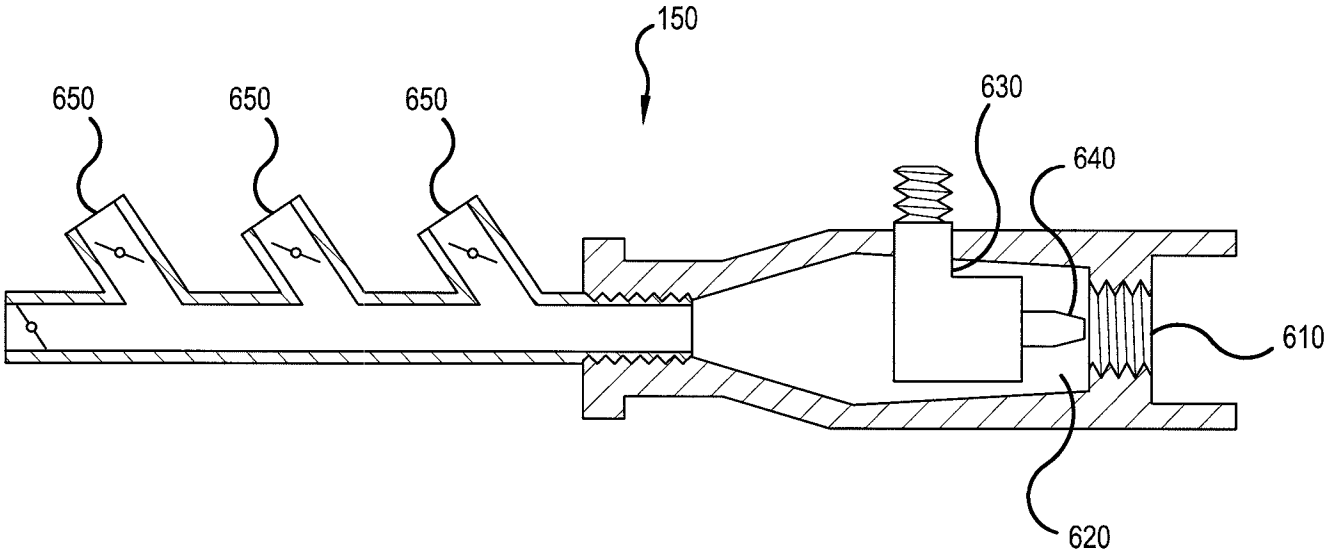
FIG. 6 is a simplified diagram of an intake manifold according to the present invention.

FIG. 6 is a simplified diagram of an intake manifold 150 and regulating valves according to embodiments of the present disclosure. Intake manifold 150 includes a threaded connection 610 for connection with the threaded connection 226 of primary combustion chamber 110. Intake manifold includes a vacuum chamber in the form of a housing 620. Housing 620 also has a compressed air nozzle inlet 630, through which compressed air is supplied by way of a compressed air nozzle 640. Unlike other systems which surround sprayed fuel mixtures with air, resulting in incomplete combustion, the presently disclosed system operates on an opposite principle of providing compressed air (approximately 10 bars or more) at the core of the flame through nozzle 640.

Regulating valves 650 provide controls for the air and gas flow into and out of the intake manifold 150. Because of the vacuum conditions, any type of combustible gas can be drawn into the combustion chambers and used in burner-reactor 100. Because of the triple vortex design, the gas mixture is more consistent regardless of the gas used, including heavier fuels, while the gas is recycled more efficiently within the combustion chambers.

As a result, previously undesirable gas fuels such as HHO can be utilized in combination with any liquid fuel, such as waste oil, Glycerin, and other fuels. This also allows for the mixture of higher-quality fuels with undesirable fuels, to reduce the amount of high-quality fuel used. Due to its capacity to burn any combination of combustible gases and liquids at the same time, its high working temperature, the injected compressed air, the vacuum and the delay in the transit of the flame through the combustion chambers due to its rotation, the described embodiments reduce the emissions and the price per KW of thermal power delivered compared with conventional energy converters. Use of the claimed embodiments also allow the proper disposal of waste oil from internal combustion engines, while residue metals contained in the waste oil condense to liquid and eventually to solid in the bottom of the second chamber.

Figure 7:
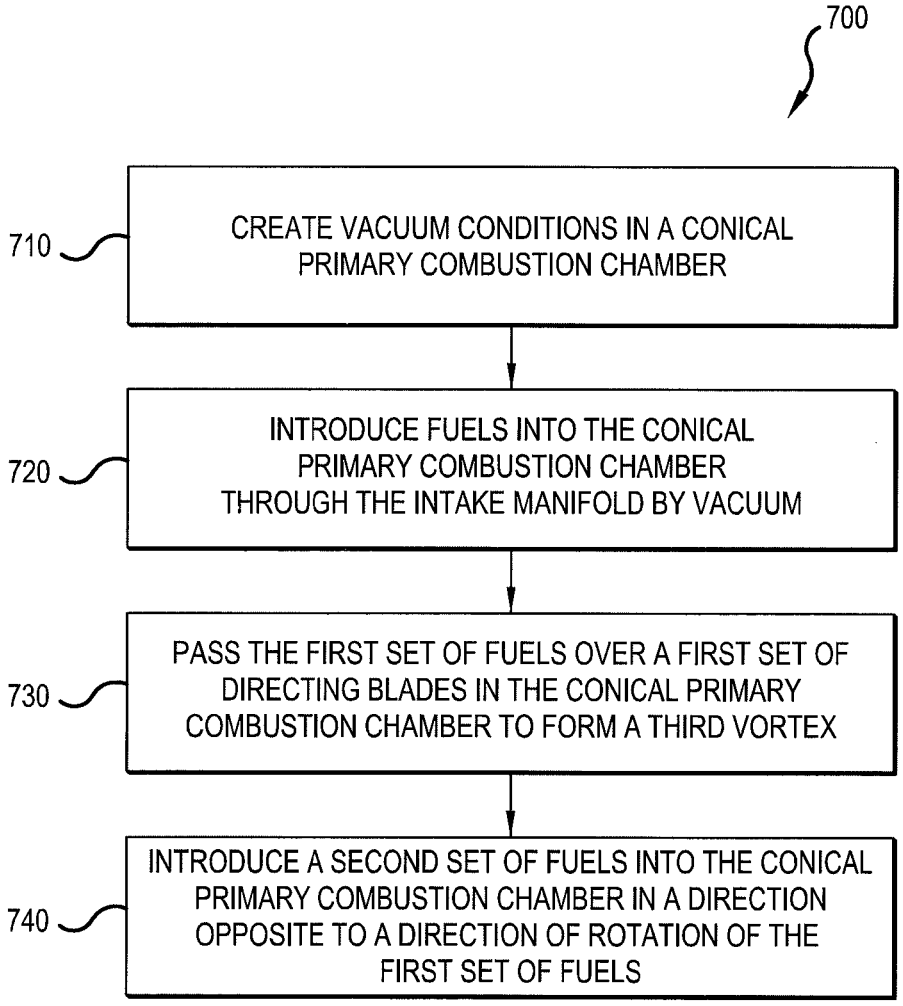
FIG. 7 is a flowchart describing a method of efficiently burning mixed fuels in a triple-vortex vacuum burner-reactor in accordance with the invention.

FIG. 7 is a flowchart of a method 700 of efficiently burning mixed fuels in a triple-vortex vacuum burner-reactor. The method begins by creating vacuum conditions in a conical primary combustion chamber by ejecting air through an intake manifold connected to the conical primary combustion chamber at a step 710. At a step 720, a first set of fuels is introduced into (i.e., sucked into) the conical primary combustion chamber through the intake manifold, such that two vortices of a first set of fuels and outlet gases are formed. The first set of fuels is passed over a first set of directing blades in the conical primary combustion chamber to form a third vortex at a step 730. The three vortexes sustain rotation through the conical combustion chamber and a secondary combustion chamber to the exterior of the burner-reactor. At a step 740, a second set of fuels is injected into the conical primary combustion chamber in a direction opposite to a direction of rotation of the first set of fuels, allowing for oxidation of a fuel mixture.

Through the formation of the three vortexes, rotation of the fuels can be maintained throughout the combustion chambers and transit of the fuels is slowed. The slower transit of the fuels leads to more complete combustion. This slower combustion cycle, in turn, promotes more complete burning, which permits burner-reactor 100 to use any combination of gaseous and liquid fuels. Lower quality fuels, such as glycerin, waste oil, or combinations of the two, can be substituted for fuels that typically burn cleaner, such as industrial fuel oil (IFO) 380 or biodiesel. In addition, fewer emissions are generated, thus resulting in more environmentally friendly heat generation. Residues and maintenance problems are reduced or eliminated, and steady reliable heat can be generated.

TABLE 1

Comparative Savings in USD

| Fuel | USD/KW/HR | Compared to Biodiesel | Compared to IFO 380 |
|---|---|---|---|
| Biodiesel | 0.144 | 0% | Loss -227% |
| IFO 380 | 0.044 | 70% | 0% |
| Soy oil | 0.127 | 12% | Loss -188% |
| Glycerin and Soy oil 50/50 | 0.0792 | 45% | Loss -79% |
| Soy oil and Wasted oil | 0.071 | 50% | Loss -61% |
| Propane/Butane | 0.07 | 51% | Loss -59% |
| Natural Gas | 0.0525 | 65% | Loss -19% |
| Glycerin | 0.315 | 78% | 28% |
| Glycerin and Waste oil 50/50 | 0.023 | 84% | 48% |
| Waste oil | 0.015 | 89% | 66% |

Experimental data of output obtained by the triple vortex burner of the present disclosure is shown in Table 1 above. Table 1 shows the cost per Kilowatt/hour of thermal power obtained from the internal combustion of glycerin and/or waste oil from engines, which is reduced from 28% to 66% compared to the cheapest industrial fossil fuel (i.e., industrial fuel oil (IFO) 380).

The above described embodiments and related experimental data provide examples of the inventive concepts of the present disclosure. Alternative embodiments include modification of the vacuum chamber and regulating valves in order to introduce solid fuels into the primary combustion chamber instead or, or in addition to, the disclosed gaseous fuels. For example, adaptation can be performed to supply carbon powder or the like from the vacuum side of the combustion chamber. This solid fuel can be mixed with gaseous and/or liquid fuels to provide a different mixture of fuels in this embodiment.

The aforementioned descriptions provide sufficient detail to allow one of ordinary skill in the art to make and use the disclosed embodiments. However, other alternative embodiments may be readily apparent given the descriptions above. Equivalents are contemplated within the spirit and scope of the present disclosure. Therefore, the subject matter of the instant disclosure should be understood to fall within the limits of the claims that follow.

What is claimed is:

1. A mixed-fuel vacuum burner-reactor comprising:

a primary combustion chamber having a conical interior and a first set of directing blades, an intake connected to a first end of the conical interior;

a reduction nozzle connected to a second end of the conical interior;

said primary combustion chamber being configured to operate under vacuum to create two vortices of a first fuel entering and exiting the primary combustion chamber due to pressure differences, and said first set of directing blades is configured to create a third vortex sustaining rotation of the first fuel to the exterior of the burner-reactor;

a first end of said reduction nozzle connected to the conical interior of the primary combustion chamber and a second end of said reduction nozzle connected to a cylindrical secondary combustion chamber;

injectors mounted substantially perpendicularly to the reduction nozzle and configured to inject a second fuel into the primary combustion chamber; and said cylindrical secondary combustion chamber comprising a second set of directing blades configured to direct air into the secondary combustion chamber.

2. The mixed-fuel vacuum burner-reactor of claim 1, wherein the primary combustion chamber has a cylindrical exterior, wherein further the first end of the conical interior of the primary combustion chamber has a smaller diameter and the second end of said interior has a larger diameter.

3. The mixed-fuel vacuum burner-reactor of claim 2, wherein the primary combustion chamber has insulating material in a space between the cylindrical exterior and the conical interior.

4. The mixed-fuel vacuum burner-reactor of claim 1, wherein the reduction nozzle has a frustoconical first portion with a larger diameter part thereof connected to the primary combustion chamber and a cylindrical second portion that extends from a smaller diameter part of the frustoconical first portion.

5. The mixed-fuel vacuum burner-reactor of claim 1, further comprising an intake manifold connected to said intake portion.

6. The mixed-fuel vacuum burner-reactor of claim 5, wherein the intake manifold includes a vacuum chamber, a compressed air nozzle extending into the intake manifold, and an ejector outlet providing an outlet.

7. The mixed-fuel vacuum burner-reactor of claim 6, wherein the compressed air nozzle is configured to inject compressed air into the primary combustion chamber at the core of a flame.

8. The mixed-fuel vacuum burner-reactor of claim 5, wherein gaseous fuel is supplied to the primary combustion chamber by way of the intake manifold.

9. The mixed-fuel vacuum burner-reactor of claim 5, wherein the intake manifold includes regulation valves connected to the ejector outlet configured to control the flow of gases in and out of the vacuum chamber.

10. The mixed-fuel vacuum burner-reactor of claim 1, wherein the injectors are configured to inject fuel into the primary combustion chamber counter to the rotation of the vortices of fuel.

11. The mixed-fuel vacuum burner-reactor of claim 10, wherein the injectors are configured to inject liquid fuel into the primary combustion chamber.

12. The mixed-fuel vacuum burner-reactor of claim 1, wherein the injectors are configured 30° to a horizontal axis of the chamber.

13. A triple-vortex burner-reactor comprising:

an intake manifold, including a vacuum chamber, a compressed air nozzle inlet into the vacuum chamber, a compressed air nozzle for injecting compressed air into the vacuum chamber through the compressed air nozzle inlet, and an ejector outlet, wherein the intake manifold is configured to supply a gaseous fuel to a primary combustion chamber;

a primary combustion chamber having a cylindrical exterior and having a conical interior, the conical interior having a first end with a smaller diameter and a second end with a larger diameter, the first end of the conical interior being connected to the intake manifold, the conical interior further including a first set of directing blades;

a reduction nozzle connected to the second end of the conical interior of the primary combustion chamber, the reduction nozzle having a frustoconical first portion with a larger diameter connected to the primary combustion chamber and having a cylindrical second portion that extends from a smaller diameter of the frustoconical first portion;

injectors perpendicular to the frustoconical first portion of the reduction nozzle configured to inject liquid fuel into the primary combustion chamber; and a cylindrical secondary combustion chamber having a second set of directing blades configured to direct air into the secondary combustion chamber, wherein the primary combustion chamber is configured to operate under vacuum to form three vortices of fuel in order to sustain rotation of the fuel to the exterior of the burner-reactor and configured to slow transit of the fuels to allow for complete combustion.

14. The mixed-fuel vacuum burner-reactor of claim 13, wherein the compressed air nozzle is configured to blow said compressed air into the core of a flame of the primary combustion chamber by way of the intake manifold.

15. The mixed-fuel vacuum burner-reactor of claim 13, wherein the injectors are configured to inject the liquid fuel into the primary combustion chamber in a direction opposite to the rotation of the gaseous fuel.

16. The mixed-fuel vacuum burner-reactor of claim 13, wherein the gaseous fuel is natural gas, a water byproduct of water electrolysis (HHO), or combinations thereof.

17. The mixed-fuel vacuum burner-reactor of claim 13, wherein the liquid fuel is waste oil, Glycerin, soy oil, industrial fuel oil (IFO), or combinations thereof.

18. A method of efficiently burning mixed fuels in a triple-vortex vacuum burner-reactor, the method comprising:

creating vacuum conditions in a conical primary combustion chamber by ejecting air through an intake manifold connected to the conical primary combustion chamber;

introducing fuels into the conical primary combustion chamber through the intake manifold, such that two vortices of a first set of fuels and outlet gases are formed due to pressure differences caused by the vacuum conditions;

passing the first set of fuels over a first set of directing blades in the conical primary combustion chamber to form a third vortex, the three vortices sustaining rotation through the conical combustion chamber and a secondary combustion chamber to the exterior of the burner-reactor; and injecting a second set of fuels into the conical primary combustion chamber in a direction opposite to a direction of rotation of the first set of fuels.

19. The method of claim 18, wherein the first set of fuels are gaseous fuels and the second set of fuels are liquid fuels.

20. The method of claim 18 further comprising introducing air into the secondary combustion chamber through blades of a secondary air inlet.

* * * * *